United States Patent [19]

Donovan

[11] Patent Number: 5,028,068

[45] Date of Patent: Jul. 2, 1991

[54] QUICK-ACTION ADJUSTABLE SNOW BOOT BINDING MOUNTING

[76] Inventor: Matt J. Donovan, 778 Sawmill Rd., Alta, Calif. 95701

[21] Appl. No.: 407,619

[22] Filed: Sep. 15, 1989

[51] Int. Cl.[5] ..... A63C 9/81

[52] U.S. Cl. ..... 280/618; 280/142

[58] Field of Search ..... 280/617, 618, 14.2, 280/620, 613

[56] References Cited

U.S. PATENT DOCUMENTS

| | | | |
|---|---|---|---|
| 4,652,007 | 3/1987 | Dennis | 280/14.2 |
| 4,728,116 | 3/1988 | Hill | 280/618 |
| 4,871,337 | 10/1989 | Harris | 280/14.2 |

*Primary Examiner*—Andres Kashnikow

*Assistant Examiner*—Richard Camby

*Attorney, Agent, or Firm*—John J. Murphey

[57] ABSTRACT

This invention is a device for pivotally mounting a snow boot binding on a snowboard on the upper surface of a snowboard, and by virture of a manually operated handle, allows the bindings to be changed in any direction desired and thereafter, with the flip of the handle, locked into the selected position. It includes a swivel plate on which the binding is mounted having a groove about the circumferential edge thereof wherein a flexible cable in placed and tightened by a locking device between positions allowing the plate to be freely rotated and a locked position against further movement, and further including a series of flexible bushings to absorb vibration and to flex when the user shifts his or her body weight.

11 Claims, 4 Drawing Sheets

QUICK-ACTION ADJUSTABLE SNOW BOOT BINDING MOUNTING

BACKGROUND OF THE INVENTION

1. Field of the Invention

This invention pertains to the field of snowboarding which is a sport wherein a person uses a single board, generally wider than a snow ski but almost as long, for recreational travel down a snow-covered inclined surface. More particularly, this invention pertains to a mounting on which the snow boot binding may be fastened to the snowboard that is rotatably adjustable and thereafter easily locked by quick action using a novel mechanism.

2. Description of the Prior Art

The popularity of snowboarding is growing all over the world and it is beginning to rival skiing as a recreational sport. In snowboarding, the person stands on the board with both feet and their body angled to the central or long axis of the board, similar to that observed in the use of a surfboard. The same snow-covered slopes and surfaces are used for snowboarding as in skiing, as well as chair lifts and other lift devices.

As in skiing, the snowboard user wears a protective boot that fits into a manually releasable binding that in turn is attached to the top surface of the snowboard. While the bindings on skiis are aligned in spaced-apart configuration directly with the central axis of each ski, in snowboarding, the bindings are placed at an angle to the central axis of the board. Normally, the binding is bolted to the upper surface of the snowboard and adjustment to the angle is only possible by unbolting and repositioning the whole binding.

Just as there are different lengths of skis desired by various skiers, the angle of the binding to the longitudinal axis of the snowboard is of importance to the snowboarder. Some snowboarders wish to have a greater angle than others and some even wish to have a different angle between the front foot and the rear foot vis-a-vis the board's central axis. Even further, some individuals wish to stand facing left of the board while others desire to stand facing the right.

These variations require the snowboard binding to be capable of being rotated with respect to the central axis of the snowboard. Presently, the state of the art of snowboarding allows the binding plate to be adjusted only by moving the plate about a central point over a plurality of holes drilled through the plate and through the snowboard that are aligned and through which are passed a series of threaded bolts or other fasteners. In addition, there are no means in the present state of the art to allow any degree of flexation between such bindings as they are bolted directly to the snowboard, thereby placing a significant amount of strain on the snowboard and on the muscles, ligaments, joints and bones of the user when operating the snowboard and changing directions by shifting his or her weight.

As with a wide variety of sporting equipment, snowboards are rented at ski slopes as are skiis ski boots and other paraphernalia. The position of the users' boots in the bindings is generally adjusted at the place of rental. Thereafter, should the user decide or determine to change position of his or her feet on the snowboard, they must return to the place of rental and wait in line for the mechanic to remove the bolts and reposition the bindings. Some people do not wish to undertake this wait and accordingly continue to use a snowboard with their boots in an undesirable position which may cause further damage to the body.

Still further, while a skier sits in the chair lift with his or her skiis pointing straight ahead, thus not intruding into the adjacent seat occupied by another skier, the snowboard user, with his or her feet set at an angle to the board's central axis, must cock the board so that it intrudes into the space occupied by the adjacent skier as straightening the board with feet pointed straight ahead places severe stress on the user's ankle and leg. Without a convenient method of aligning the snowboard with the skiis of the skier, the snowboard user poses inconvenience to the chair lift rider or danger to himself or herself.

SUMMARY OF THE INVENTION

This invention cures all of the above problems by providing a quick-action snow boot binding mounting for snowboards. It represents a significant advance in the state of the art of snowboarding. This invention comprises means for mounting the snow boot binding pivotally on the upper surface of the snowboard, and by virtue of a manually operated handle, allows the bindings to be changed in any direction desired and thereafter, with the flip of the handle, lock them into the selected position. Further, this invention includes means interposed between the snow boot binding and the snowboard for allowing a degree of flexation therebetween without changing the overall position of the snow boot binding with respect to the board. This improvement relieves the stress and strain on the muscles, ligaments, joints and bones of the user thereby providing more pleasure in the utilization of the snowboard.

Further, this inventive quick-action snow boot binding mounting may be retrofitted on existing snowboards thereby permitting the rental agencies to retrofit them on their existing stock and thereafter relieve the mechanic of his arduous and time-consuming task of repositioning the bindings on the snowboard for people who come off the slopes complaining about the original positioning. The invention involves a plurality of elements made of strong material that may be utilized without hesitation in the cold and wet environments of the snow-covered slopes and that are ruggedly assembled and permit quick adjustment on the slopes without the necessity of carrying tools or disassembling the snowboard or any part thereof while on the snow. This mounting even permits the binding mountings to be repositioned without removing one's boots from the mountings.

Accordingly, the main object of this invention is to provide a quick-action snow boot binding mounting for a snowboard that is quickly adjustable while out on the slopes without the use of separate tools or other implements and without removing one's boots from the mountings. Other objects of the invention include a snow boot binding mounting that permits unrestrained rotation through a 360° arc about the snowboard to allow use by both those who wish to face the snowboard from the left, as well as those who wish to face the snowboard from the right; a snowboard binding mounting that may be retrofitted on existing snowboards; a binding that is adjustable to compensate for wear or changes in temperature both on the snow slopes and inside a heated building, and a mounting that is adaptable for both the rear foot and the front foot on the snowboard.

These and other objects will become apparent from a reading of the Description of the Preferred Embodiment taken together with the Drawings appended hereto. The scope of protection claimed by the inventor may be gleaned from a fair reading of the claims which conclude this specification.

DESCRIPTION OF THE PREFERRED EMBODIMENTS

Figure 1:
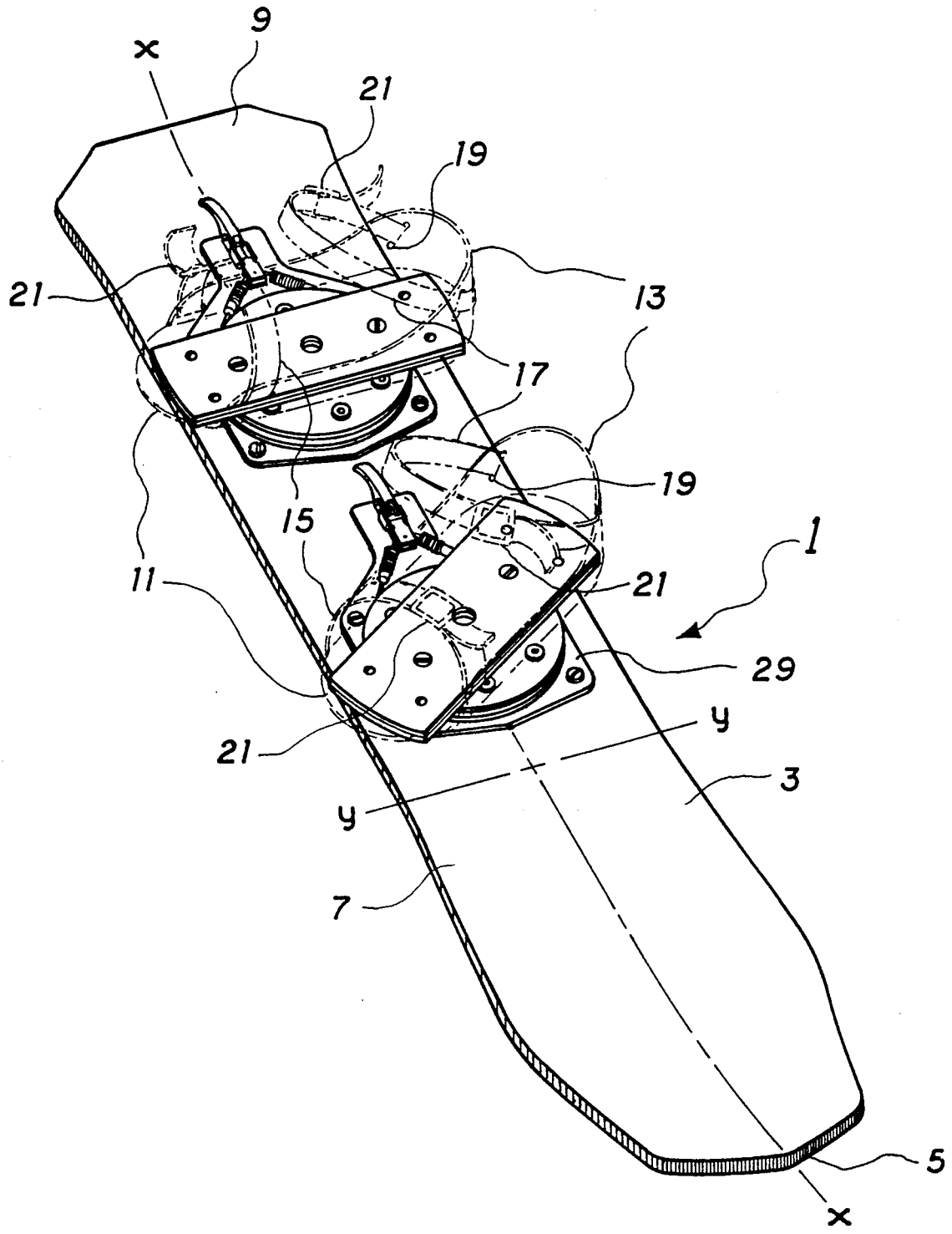
FIG. 1 is an illustrative view of a typical snowboard showing the ski bindings mounted using the quick-action snow boot binding mounting of this invention.

As shown in the figures, where like elements are identified with like numerals throughout the six figures, one embodiment of this invention is shown in FIG. 1 and generally shows a typical snowboard 1 comprising an elongated member 3, wider than a regular snow ski, having a central axis x—x, with a pointed front end 5, sometimes slightly upturned out of the plane y—y which is coincident with the flat snowboard top surface 7, and a blunt rear end 9 preferably rounded as shown. Snowboards are generally made from either wood or plastic-coated wood, wood laminates and laminates of various plastics including reinforced plastic such as glass fiber matting, etc.

Characteristically, each snowboard has a set of snow boot bindings 11. Bindings 11 generally comprise a snow boot holding member 13 made of plastic, metal or other material and including wires, springs, snaps and other devices to hold the snow boot in the binding. As shown in FIG. 1, each holding member 13 has a lower boot strap 15 and an upper boot strap 17 attached to member 13 by passing through various slots 19 formed in member 13 for encompassing the snow boot and holding member 11. Said straps are affixed about the boot by strap fasteners 21 to hold the user's snow boots tightly therein.

In some instances, the snow boot binding may be in the form of a rigid narrow plate with loops that hold down the heel and toe of the ski boot. Both type of attachments will benefit from my invention. Accordingly, in this patent application, I shall use the term, "snow boot" with respect to the term, "binding mounting" and that shall be taken to include both bindings for snow boots and the "loop" type snow boot attached directly to the snowboard.

As shown in FIGS. 1 through 4, the quick-action, adjustable snowboard binding mounting of this invention comprises a first means 23 for pivotally mounting snow boot binding 11 in spaced-apart, parallel planar relation above plane y—y and the top surface of snowboard 1. First means 23 includes at least one support 25 on which snow boot holding member 13 of binding 11 is to be mounted. A series of apertures 27 are formed in support 25, each surrounded by a T-nut 28, over which is positioned holding member 13 as shown in dotted lines in FIG. 2. A spring lock, already known in the art, or a series of threaded fasteners received in T-nuts 28 may thereafter be used to hold the bindings fast to support 25. An adaptor plate 29 is provided for bolting, gluing or otherwise fastening directly to snowboard top surface 7. A swivel plate 31, preferably circular in outline, is pivotally mounted atop adaptor plate 29 and made freely pivotable thereon by a center bearing 33, received in adaptor plate 29 (see FIGS. 4*a* and 4*b*) for receipt of a through-bolt 35. Support 25 is pivotally affixed to swivel plate 31.

Figure 2:
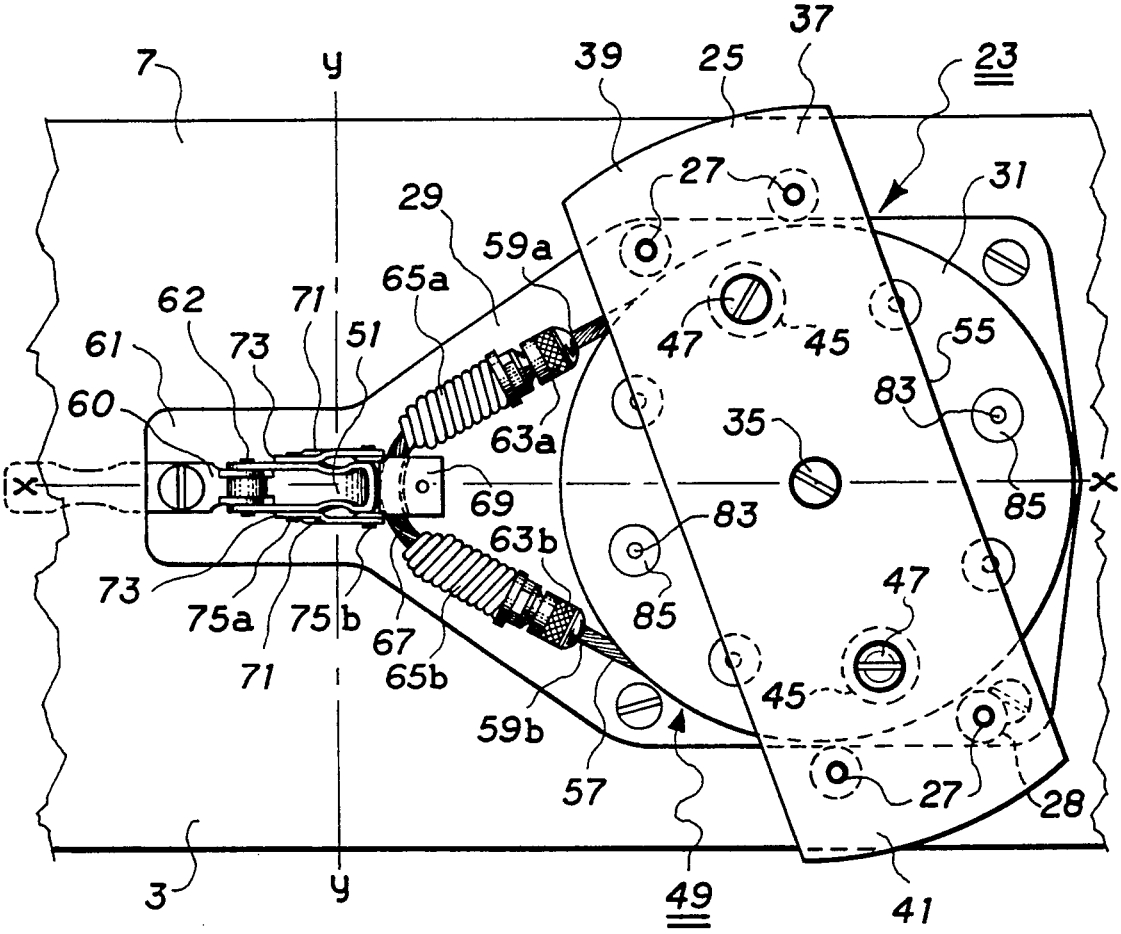
FIG. 2 is a top-plan view of one embodiment of the quick-action snow boot binding mounting of this invention.
Figure 4A:
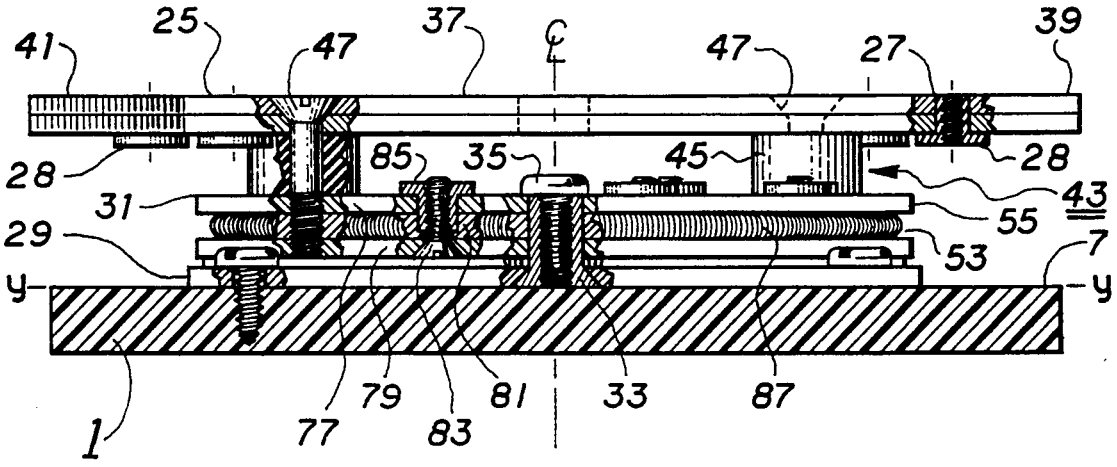
FIG. 4*a* is an end elevational view of the embodiment shown in FIG. 3 showing the mounting support 90° to that shown in FIG. 3.

Support 25, on which snow boot binding 11 may be mounted, is shown in FIGS. 2 and 4*a* to comprise an elongated plate 37 having a rear terminal end 39 on which the heel or back portion of snow boot holding member 13 is positioned, and a forward end 41 for positioning adjacent the forward end of snow boot holding member 13. Other types of supports 25 are contemplated in this invention and may include one or more arms crisscrossing underneath snow boot bindings 11 or other support.

It is important in snowboarding to allow for flexation of the foot and ankle during use. The reason is that, in the absence of the second ski or board, all changes of direction must be generated from the shifting of one's weight on the snowboard. Weight-shifting may be done on a single ski or board, however, the body must be flexed in the direction of the weight shift in order to avoid over stressing joints and other portions of the body.

Figure 3:
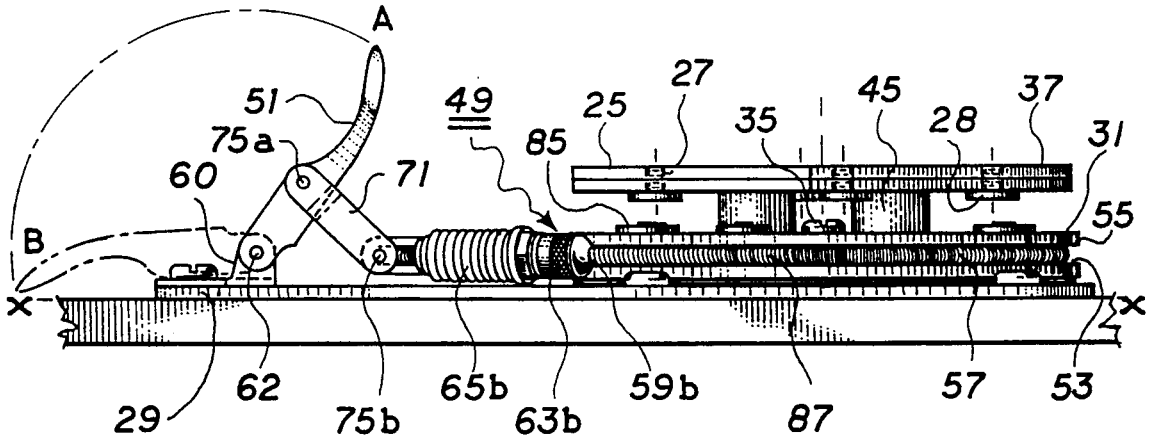
FIG. 3 is a side elevational view of the same embodiment shown in FIG. 2 showing the binding support in one position.
Figure 4B:
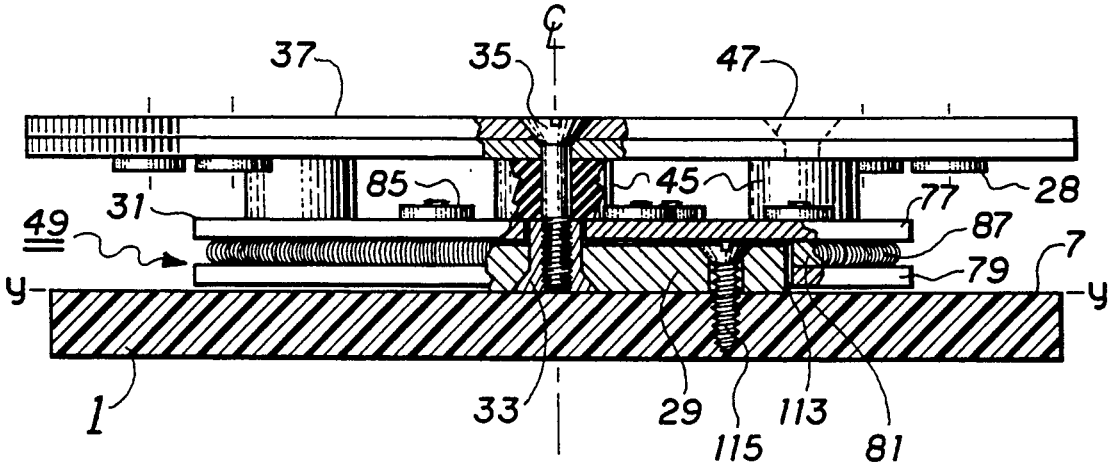
FIG. 4*b* shows, in fragmentary view, another embodiment of arranging the mounting on the snowboard similar to the view of FIG. 4*a;*

This invention allows for such flexation by providing second means 43. interposed elongated plate S and swivel plate S1. As shown in FIGS. 3, 4*a* and 4*b*, second means 43 includes a plurality of flexible members such as flexible bushings 45 that are interposed between support plate 25 and swivel plate 31 and held fast thereto by fasteners such as bolts and nuts 47 to allow flexation of support 25 and snow boot bindings 11 with respect to snowboard 1. Flexible bushings 45 may be made from a wide range of polymeric materials such as natural rubber, synthetic rubber and rubber-polymer blends.

The pivotable mounting of swivel plate 31 on adaptor plate 29 permits rotation of snow boot binding 11 throughout 360° co-planar with, i.e., in a plane parallel to plane y—y and top surface 7 of snowboard 1. To restrain further pivotal movement of snow boot bindings 11, once the desired position has been selected by the user, third means 49 is provided that includes a handle 51.

As shown in FIGS. 2, 3 and 4*a*, third means 49 comprises a groove 53 or other depression formed in edge 55 of swivel plate 31, preferably a circumferential edge 55, and a flexible cable 57 of finite length and terminated by first and second ends 59 and 61 received in groove 53 and passed around a greater portion of swivel plate 31. Handle 51 is pivotally mounted on a bracket 59 that is in turn mounted on an extension 61 of adaptor plate 29 by a pivot pin 63. The free ends 59 and 61 of flexible cable 57 are attached through a pair of threaded adjustment nuts 63*a* and 63*b* and tension springs 65*a* and 65*b* to a yoke stem 67 that is in turn centrally held by a yoke 69. A pair of spaced-apart pull arms 71 pivotally connect one end 73 of yoke 69 to handle 51 on the opposite side of pivot pin 63 from yoke 69 through a pair of spaced-apart pivot pins 75*a* and 75*b*.

As shown in FIG. 3, handle 51 may be moved from a first position, shown in dotted line marked "A", wherein pull arms 71 pivot about pin 63 and move toward swivel plate 31 thereby loosening flexible cable 57 in groove 53 to allow swivel plate 31, support 25 and snow boot binding 11 to freely rotate with respect to central snowboard axis x—x. Thereafter, handle 51 may be moved down to a second locked position "B" flush against snowboard top surface 7, where pull arms 71 tighten flexible cable 57 in groove 53 to restrain swivel plate 31 from further rotation. In position "B", pivot pin 75 is further outboard than handle pivot pin 63 and, through the combined pulling of tension springs 65*a* and 65*b* from tightened flexible cable 57 through yoke 69, pull arms 71 and pivot pin 75*a*, handle 51 is spring-loaded into a locked position. Further rotational adjustment of snow boot bindings 11 is quickly and easily permitted by lifting handle 51 from its locked-down position "B" into its upper-most position "A" to loosen flexible cable 57 in groove 53 and thereafter merely pushing down on handle 51 to relock snow boot bindings 11 in their new position. This provides ease in adjusting the angle of the foot while on the slope and in straightening the snowboard in preparation to use the chair lift This combination of spring tension from springs 65*a* and 65*b* and the tension in cable 57 spread widely about swivel plate S1 as well as the angle cable 57 makes with the center line of snow board 1 allows for emergency twisting of plate 37 during periods of intense torsional load such as when the user has fallen, or their foot is caught in an awkward position, or, they are in a chair lift. This emergency twisting of plate 37, to relieve the torsional load from the caught-foot, prevents spiral fracture of the leg or ankle bone, a common problem encountered in skiing.

Swivel plate 31 may be conveniently fabricated by a sandwich of three plates, such as from steel or other strong material, as shown in FIG. 4*a*. The sandwich comprises top and bottom outer plates 77 and 79 respectively, mounted in spaced-apart relation by center plate 81, plate 81 having a smaller diameter than those of plates 77 and 79 to form groove 53 previously described for receipt therein of flexible cable 57. Plates 77, 79 and 81 are held together by a series of threaded fasteners such as bolts 83 whose heads are preferably made flush with the bottom of bottom plate 79 and whose threaded nuts 85 positioned above top plate 77 are made thin as shown in FIGS. 3 and 4.

Flexible cable 57 may be made in different forms such as a multistrand cable, as shown in FIG. 2, or as a tightly wrapped coil of wire 87 as shown in FIGS. 3 and 4*a* that may also stretch slightly when handle 51 is moved from position "A" to its locked-down position "B".

Figure 5:
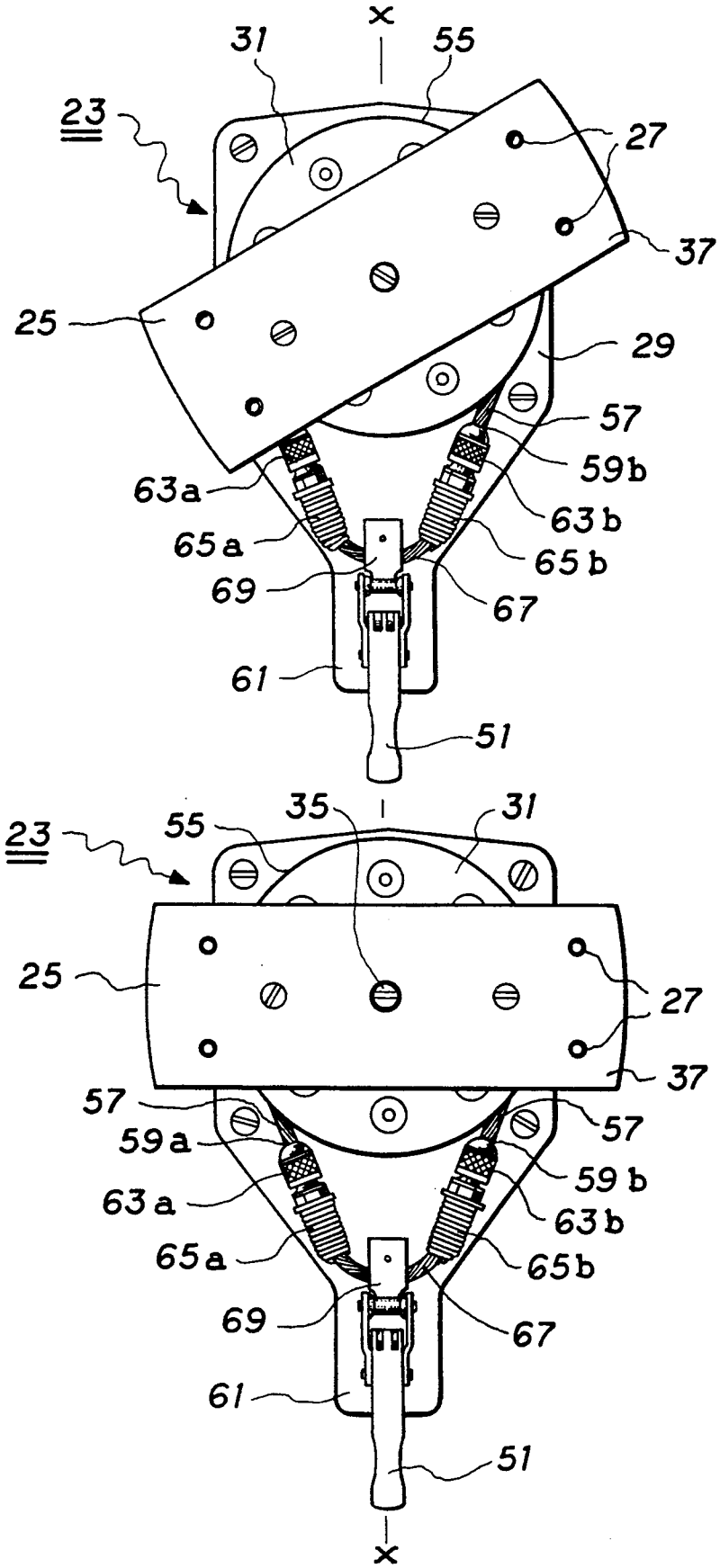
FIG. 5 is another embodiment of the invention showing its use with both the fore and aft snow boot binding mountings.

A further embodiment of this invention is seen in FIG. 5 wherein a pair of quick-action snow boot binding mountings are placed on top surface 7 of snowboard facing in the same direction, preferably to the rear of snowboard 1. This embodiment provides for adjustment of both front and rear snow boot bindings and allows the bindings to be locked in the desired position with quick movement of handles 51 located near each other.

A still further embodiment of the invention is shown in FIG. 4*b* where adaptor plate 19 is moved totally underneath swivel plate 31, in a cut-out portion 113 formed therein and mounted to snowboard 1 with screws 115. In this embodiment, third means 49 is mounted directly onto snowboard top surface 7.

What is claimed is:

1. A quick-action snow boot binding mounting for a snowboard comprising:

a) first means for mounting said binding in spaced-apart, parallel planar relation above the top surface of an elongated snowboard for rotational movement with respect to the central axis of the board, including at least one support on which the binding is to be mounted, wherein said first means includes:
   i) an adaptor plate for mounting on the top surface of the snowboard; and,
   ii) a swivel plate pivotally mounted atop said adaptor plate;

b) second means interposed said support and the snowboard permitting flexation therebetween without hindering the rotational movement of said first means; and, c) third means for restraining rotation of said first means from a selected position of the snow boot binding including a handle operative from above the snowboard, for manual movement between a first, unlocked position where rotation of said support is not restrained, and a second, locked position, where further rotation is restrained, wherein said third means includes:
   i) a groove formed about the edge of said swivel plate;
   ii) a flexible cable of finite length received in said groove and passing around the greater portion of said swivel plate; and,
   iii) wherein the ends of said cable are attached to said handle so that said handle may be moved between said first position, wherein said cable loosely encircles said swivel plate allowing said plate to freely rotate, and said second position wherein said cable is tightly drawn into said groove to restrain said swivel plate from further rotation.

2. The quick-action snow boot binding mounting of claim 1 wherein said cable is comprised of a tightly wrapped coil of wire of length sufficient to extend about the greater portion of said plate and be attached by its ends to said handle.

3. The quick-action snow boot binding mounting of claim 2 further including means for shortening said cable so that it is stretched tightly when said handle is moved between said first and second positions to allow said handle to become spring-loaded in said second position when said cable is stretched against said groove in said swivel plate.

4. The quick-action snow boot binding mounting of claim 3 wherein said means for shortening the length of said cable include a spring-loaded first element extending from said handle toward said first end of said cable and a second element threaded to said first element and connected to said end of said cable so that by intertwisting of said first and second elements, the length of said cable is shortened or lengthened.

5. A quick-action snow boot binding mounting for a snowboard comprising:

a) first means for mounting said binding in spaced-apart, parallel planar relation above the top surface of an elongated snowboard for rotational movement with respect to the central axis of the board, including at least one support on which the binding is to be mounted, wherein said first means includes:

i) an adaptor plate for mounting on the top surface of the snowboard; and, ii) a circular swivel plate pivotally mounted atop said adaptor plate;

b) second means interposed said support and the snowboard permitting flexation therebetween without hindering the rotational movement of said first means; and, c) third means for restraining rotation of said first means from a selected position of the snow boot binding including a handle operative from above the snowboard, for manual movement between a first, unlocked position where rotation of said support is not restrained, and a second, locked position, where further rotation is restrained.

6. A quick-action snow boot binding mounting for a snowboard comprising:

a) a pair of first means for mounting a pair of said bindings mutually spaced apart in spaced-apart, parallel planar relation above the top surface of an elongated snowboard for independent rotational movement with respect to the central axis of the board, each said first means including at least one support on which the binding is to be mounted and further including:

i) an adaptor plate for each of said first means for direct mounting on the snowboard; and, ii) a swivel plate for each of said first means pivotally mounted atop said adaptor plate;

b) a pair of second means, one interposed each said first means between said support and the snowboard permitting flexation therebetween without hindering the rotational movement of said first means; and, c) a pair of third means in faced together relationship for restraining rotation of each of said first means from a selected position of the snow boot binding including a handle for each means operative from above the snowboard, for manual movement between a first, unlocked position where rotation of said support is not restrained, and a second, locked position, where further rotation is restrained ans further including:

i) a groove formed about the edge of each said swivel plate; and ii) a flexible cable of finite length received in each said groove and passing around the greater portion of each said swivel plate;

iii) wherein the ends of each said cable are attached to said respective handle so that said handle may be moved between a first position, wherein said cable loosely encircles said swivel plate, allowing said plate to pivotally rotate, and a second position wherein said cable is tightly drawn into said groove to restrain said swivel plate from further rotation.

7. The quick-action snow boot binding mountings of claim 6 wherein each said cable is comprised of a tightly-wrapped coil of wire of length sufficient to extend around the greater portion of said plate and be attached by their respective ends to said respective handle.

8. The quick-action snow boot binding mountings of claim 7 further including means for shortening the length of each said cable so that it is stretched tightly when each said handle is moved between said first and second positions to allow each said handle to become spring-loaded in said second position when each said cable is stretched against its respective grooves in each respective said swivel plate.

9. The quick-action snow boot binding mountings of claim 8 wherein said means for shortening the length of each said cable include a spring-loaded first element extending from said handle toward said first end of said cable and a second element threaded to said first element and connected to said end of said cable so that by intertwisting of said first and said second elements, the length of each said cable is shortened or lengthened.

10. The quick-action snow boot binding mountings of claim 6 wherein each said swivel plate is circular in shape.

11. A quick-action snow boot binding mounting for a snowboard comprising:

a) first means for mounting said binding in spaced-apart, parallel planar relation above the top surface of an elongated snowboard for rotational movement with respect to the central axis of the board, including at least one support on which the binding is to be mounted wherein said first means includes:

i) an adaptor plate for mounting on the top surface of the snowboard; and, ii) a swivel plate pivotally mounted atop said adaptor plate;

b) second means interposed said support and the snowboard permitting flexation therebetween without hindering the rotational movement of said first means; and, c) third means for restraining rotation of said first means from a selected position of the snow boot binding including a handle operative from above the snowboard, for manual movement between a first, unlocked position where rotation of said support is not restrained, and a second, locked position, where further rotation is restrained, wherein said swivel plate is comprised of a sandwich of three individual plates wherein said middle plate has an outer circumference less than that of the other two plates so as to form a groove intermediate said plate about the circumferential edge thereof.

* * * * *